US010834984B2

(12) United States Patent
Farnum et al.

(10) Patent No.: US 10,834,984 B2
(45) **Date of Patent: *Nov. 17, 2020**

(54) DUAL RETRACTABLE SEAM RIPPER

(71) Applicant: DPG USA Inc, Schaumburg, IL (US)

(72) Inventors: Ronald C. Farnum, Lombard, IL (US); Sabrina Katz, Chicago, IL (US); Evan Ward, Chicago, IL (US); Daniel Schaumann, Chicago, IL (US)

(73) Assignee: DPG USA Inc., Schaumberg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/252,404

(22) Filed: Jan. 18, 2019

(65) Prior Publication Data

US 2019/0150544 A1 May 23, 2019

Related U.S. Application Data

(62) Division of application No. 15/288,971, filed on Oct. 7, 2016, now Pat. No. 10,219,567.

(Continued)

(51) Int. Cl.

| | |
|---|---|
| ***A41H 31/00*** | (2006.01) |
| ***D05B 89/00*** | (2006.01) |
| ***B26B 1/08*** | (2006.01) |

(52) U.S. Cl.

CPC ..... *A41H 31/005* (2013.01); *A41H 31/00* (2013.01); *B26B 1/08* (2013.01); *D05B 89/00* (2013.01)

(58) Field of Classification Search

CPC ..... A41H 31/005; A41H 31/00; B26B 1/08; D05B 89/00

(Continued)

(56) References Cited

U.S. PATENT DOCUMENTS

| | | | |
|---|---|---|---|
| 373,580 | A | 11/1887 | Boynton |
| 2,775,034 | A | 12/1956 | Bulecki |

(Continued)

FOREIGN PATENT DOCUMENTS

| | | | |
|---|---|---|---|
| DE | 3231934 | C2 | 10/1986 |
| GB | 924764 | A | 5/1963 |

OTHER PUBLICATIONS

International Search Report and Written opinion in parent application (U.S. Appl. No. 15/288,971) dated Dec. 20, 2016.

(Continued)

*Primary Examiner* — Ghassem Alie
*Assistant Examiner* — Nhat Chieu Q Do
(74) *Attorney, Agent, or Firm* — Robert S. Alexander; Anna L. Kinney; Ferrells, PLLC

(57) ABSTRACT

A dual blade retractable tool is provided. The tool has a round tubular housing and a one-piece injection molded slide block structure. The housing has a longitudinally extending control slot and two ends with blade extension openings, one major and one minor. The one-piece structure has a major blade and a minor blade, each carried by a support. Each blade projects through the corresponding blade extension opening. One support is attached to a leaf spring cantilevered at the other end. The spring carries a control button, which projects through and moves within the slot, and a locking pin, which extends beyond the spring perpendicular to the control slot. Depressions in the tube engage and dis-engage with the locking pin as the button is pressed and moved.

6 Claims, 7 Drawing Sheets

Related U.S. Application Data

(60) Provisional application No. 62/239,147, filed on Oct. 8, 2015.

(58) Field of Classification Search
USPC ..... 30/152, 162
See application file for complete search history.

(56) References Cited

U.S. PATENT DOCUMENTS 3,100,935 A * 8/1963 Leafe ..... B26B 27/00 30/294
3,863,339 A 2/1975 Reany et al.
5,093,994 A 3/1992 Karas
5,230,152 A 7/1993 Kennedy
5,297,340 A * 3/1994 Kahlcke ..... D05B 89/00 30/155
D351,059 S * 10/1994 Kahlcke ..... D3/18
5,896,667 A * 4/1999 Hawkins ..... B26B 1/00 30/2
6,006,433 A * 12/1999 Baltazar ..... B26B 5/001 30/152
7,322,110 B2 1/2008 Hernandez et al.
8,006,388 B1 * 8/2011 DeJesus ..... B23D 51/10 30/152
8,375,588 B2 2/2013 Gringer
8,701,293 B2 4/2014 Sullivan
8,713,766 B2 5/2014 Wiman
10,092,052 B2 * 10/2018 Farnum ..... A41H 31/005
10,729,198 B2 * 8/2020 Iwasaki ..... B26B 1/08
2005/0193568 A1 9/2005 Peyrot et al.
2007/0125398 A1 * 6/2007 Johnson ..... A45D 2/00 132/200
2008/0235954 A1 10/2008 Radle
2014/0165409 A1 * 6/2014 Scimone ..... B26B 5/003 30/162
2014/0277042 A1 * 9/2014 Racenet ..... A61B 17/32001 606/170
2016/0128712 A1 * 5/2016 Ruggiero, Sr. .... A61B 17/3211 606/167

OTHER PUBLICATIONS

International Preliminary Report on Patentability in parent application (U.S. Appl. No. 15/288,971) dated Jan. 16, 2018.

* cited by examiner

DUAL RETRACTABLE SEAM RIPPER

CLAIM FOR PRIORITY

This application is a divisional application of application Ser. No. 15/288,971. Application Ser. No. 15/288,971 was based on U.S. Provisional Patent Application Ser. No. 62/239,147, filed on Oct. 8, 2015, the priority of which is claimed, and the disclosure of which is incorporated by reference.

BACKGROUND OF THE INVENTION

"To err is human" so it is safe to conjecture that seam rippers, in one form or another, have been around almost since the dawn of sewing. Traditionally, these take the form of a fixed blade having a U-shaped cutting-edge recessed at the base of a larger U-shaped thread guide. In the typical case, the blade is fixed to an elongated rod shaped handle and a mating cover detachably mounting upon the handle covers the blade when not in use. Commonly, the detachable mating cover can also mount upon the rearmost end of the handle in the hope, often vain, that it will not be lost. In some cases, the handle is formed to be grasped between the thumb and forefinger. Curiously, a commercially available embodiment of a retractable blade design uses a curved blade rather than the more commonly encountered U-shaped. In other cases, less commonly, a method for shielding the blade in the handle is provided, either by retracting the blade into the handle or by rotating it into a slot formed in the handle. In still another case, a light is provided in the handle to facilitate accuracy.

However, what has heretofore been lacking in the retinue of tools available to the tailor or seamstress is a compact ergonomic dual retractable seam ripper.

SUMMARY OF THE INVENTION

The present invention is drawn to a dual blade retractable seam ripper. The seam ripper comprises a generally cylindrical tube and a blade holding/slide block/control button/locking portion disposed within the tube.

The tube has two ends and a longitudinally extending control slot formed in and extending a major portion of the length of the tube. Each end of the tube has a cap thereupon. One cap has a major centrally located blade extension opening formed therein. The other cap has a minor centrally located blade extension opening formed therein.

The blade holding/slide block/control button/locking portion has a major seam ripping blade support portion, a minor seam ripping blade support portion, and a control button carried upon a medial portion of a leaf spring. The control button projects through the control slot and is movable therein. The locking portion is selectably engageable as the control button is moved in the control slot and is pressed inwardly. A major seam ripper blade, projectable through the major blade extension opening, is carried by the major seam ripping blade support portion. A minor seam ripping blade, projectable through the minor blade extension opening, is carried by the minor seam ripping blade support portion.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures:

In FIG. 1, the large ripper blade is extended. In FIG. 2, the small blade is extended.

DETAILED DESCRIPTION OF THE PREFERRED EMBODIMENT

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

Figure 1:
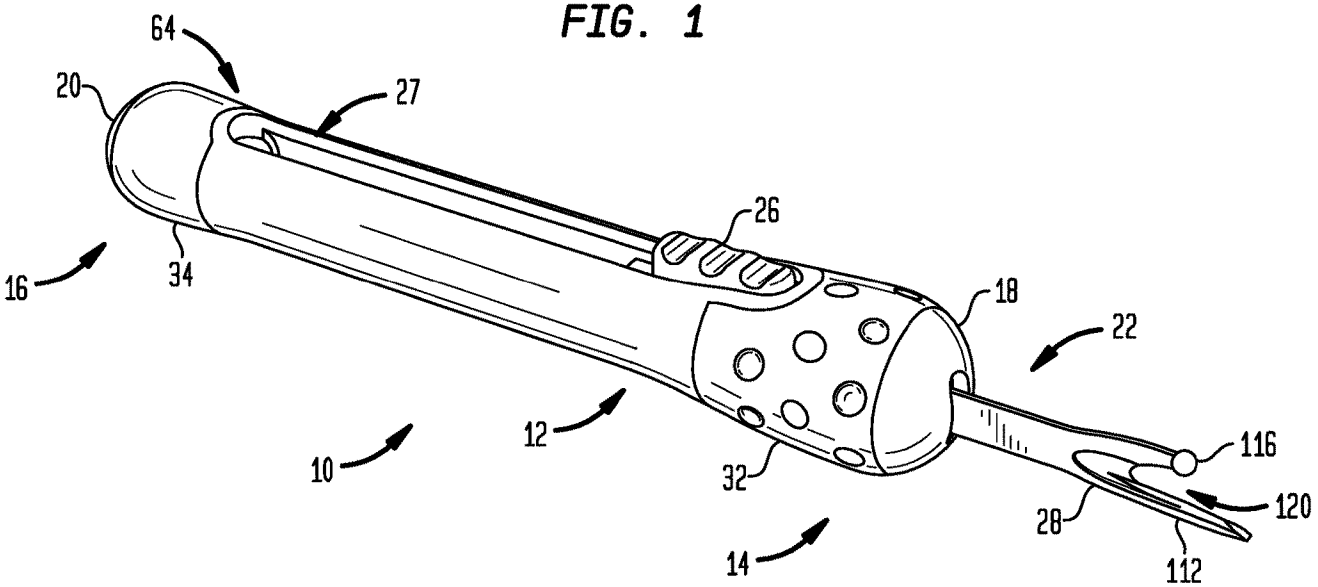
FIGS. 1 and 2 are isometric perspectives of the dual retractable seam ripper of the present invention.
Figure 2:
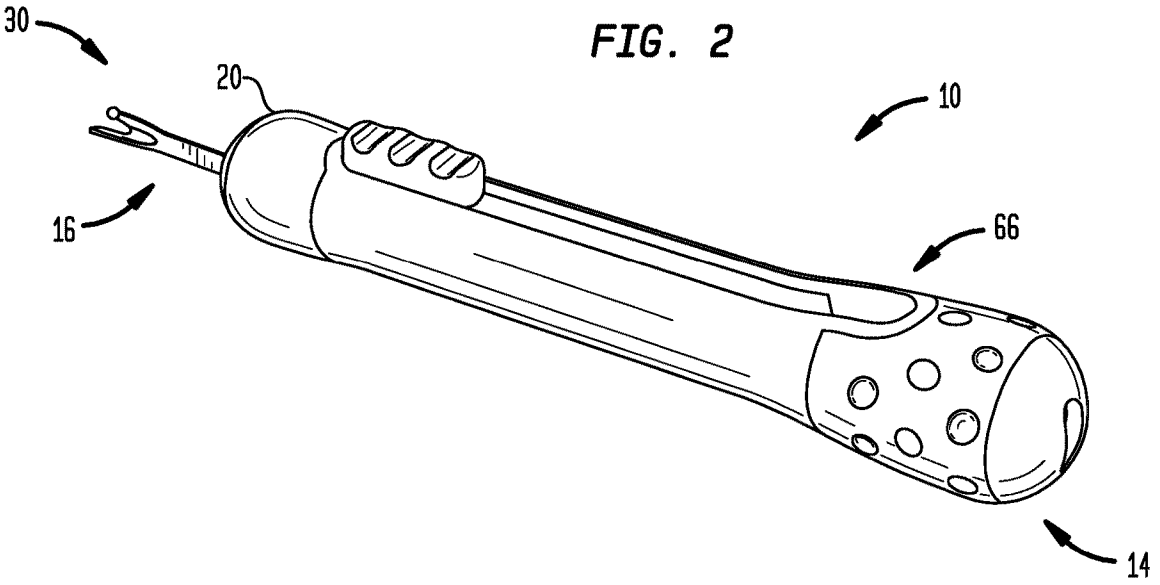
Figure 3:
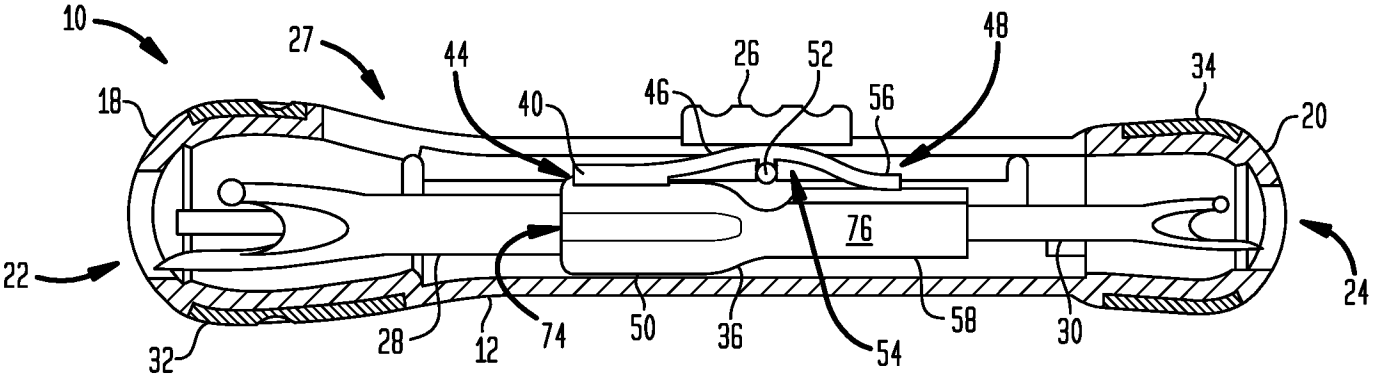
FIGS. 3, 4, and 5 are sectional views of the compact ergonomic dual retractable seam ripper of the present invention illustrating the internal mechanism by which either blade may be extended and locked in position by pressing a control button inwardly to disengage the locking mechanism, sliding the block longitudinally in the housing and releasing the control button to allow the blade to be locked in either of the extended positions.
Figure 4:
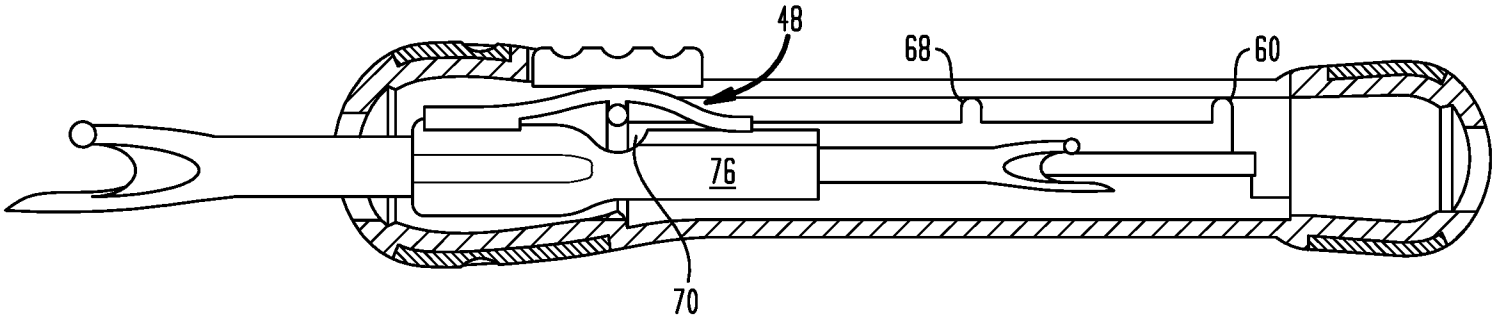
Figure 5:
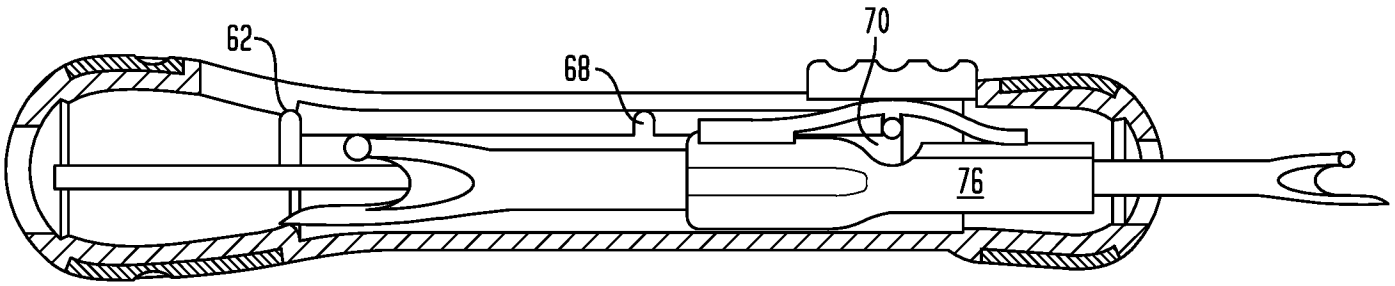

In FIGS. 1 and 2, dual blade retractable seam ripper 10 comprises slotted, generally cylindrical tube 12 with each end 14, 16 having a generally hemispherical cap 18, 20 with major and minor centrally located blade extension openings 22, 24 formed therein. Control button 26 projects through control slot 27 and is movable therealong. In FIG. 1, major seam ripper blade 28 projects through major blade extension opening 22 formed in generally hemispherical cap 18. In FIG. 2, minor seam ripping blade 30 projects through minor blade extension opening 24 in generally hemispherical cap 20. To facilitate easy use of the dual retractable seam ripper of the present invention, thermoplastic elastomer cushions 32, 34 are overmolded around each end of generally cylindrical tube 12 so that ends 14, 16 are enlarged and bulbous having a somewhat greater diameter than tube 12. In FIGS. 3, 4, and 5, unitary blade holding/slide block 36 and control button 26 are combined in one injection molded piece with base 40 of integrally formed spring 48 being attached to upper surface 44 of blade holding/slide block 36 with leaf 46 of integrally formed spring 48 projecting upwardly from major blade retention portion 50 of blade holding/slide block 36 into control slot 27 while carrying locking pin 52 beneath medial portion 54 of leaf 46 with cantilevered end 56 of leaf 46 floating above minor blade retention portion 58 of blade holding/slide block 36 when control button 26 is in its upwardly extended position but bearing against minor blade retention portion 58 of blade holding/slide block 36 when control button 26 is pressed inwardly. In FIG. 3, right blade locking depression 60 and left blade locking depression 62 are visible above minor seam ripper blade 30 and major seam ripping blade 28 adjacent left and right ends 64, 66 of control slot 27. As illustrated in FIG. 4, when unitary blade holding/slide block 36 is positioned adjacent left end 64 of control slot 27, major seam ripper blade 28 projects through major blade extension opening 22 in generally hemispherical cap 18 while in FIG. 5, minor seam ripper blade 30 projects through minor blade extension opening 24 in generally hemispherical cap 20. In each of FIGS. 4 and 5, central blade locking depression 68 is visible above the retracted seam ripping blade. In FIG. 3, locking pin 52 engaging central locking depression 68 holds unitary blade holding/slide block 36 along with both major seam ripping blade 28 and minor seam ripping blade 30 within generally cylindrical tube 12 that, while in FIG. 4, locking pin 52 engages left locking depression 62, holding major seam ripping blade 28 extended, while similarly in FIG. 5, locking pin 52 engages right locking depression 60, holding minor seam ripping blade 30 extended. Unitary blade holding/slide block 36 has medial relief 70 formed in blade holding/slide block 36 to accommodate locking pin 52 when control button 26 is depressed to dislodge locking pin 52 from locking depressions 60, 62, and 68 while, when moving between locking depressions, downwardly projecting cantilever leaf end 56 bears against minor blade retention portion 58 of blade holding/slide block 36 to guard against excessive deflection thereof.

Figure 6:
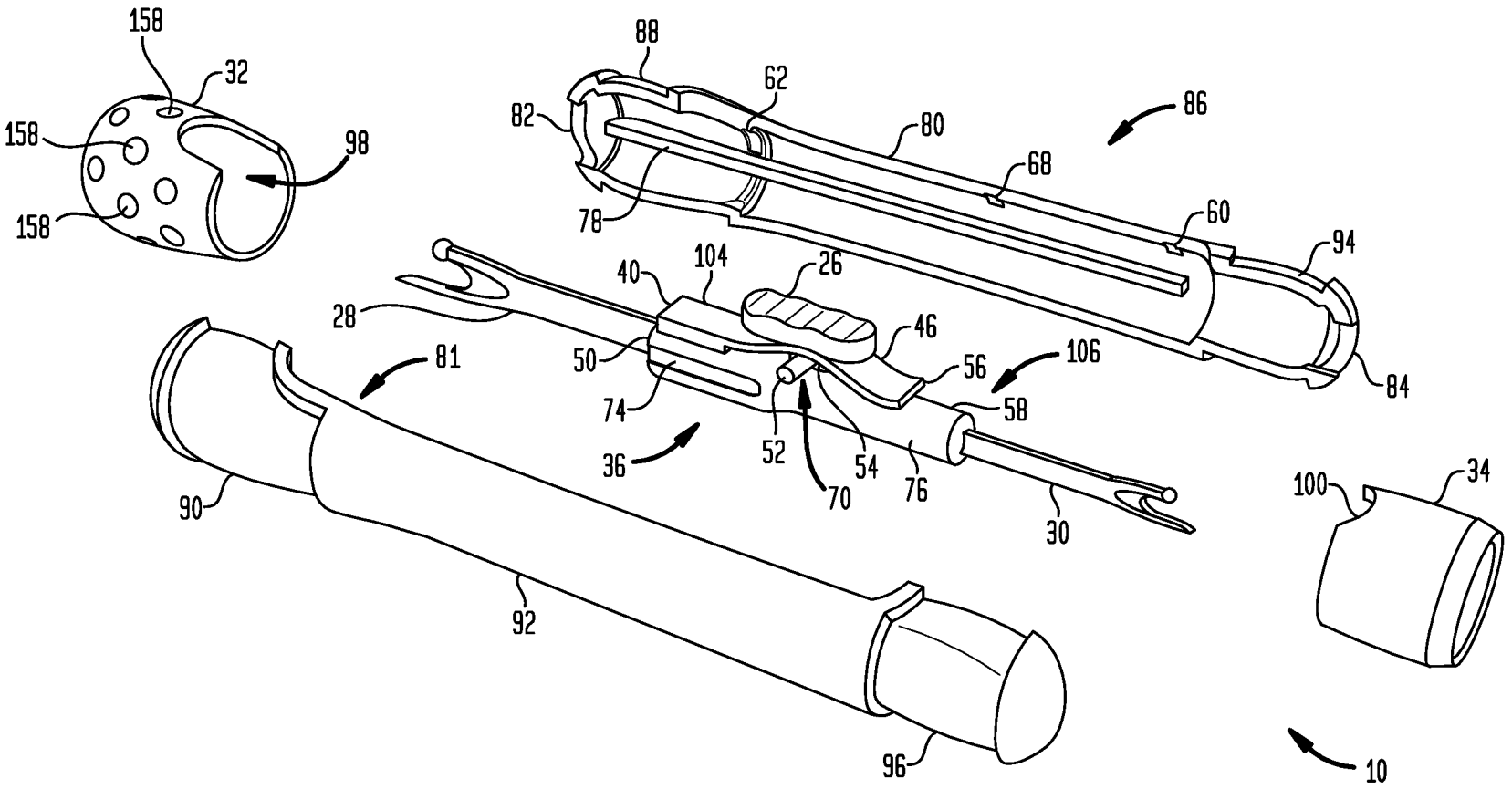
FIG. 6 is an exploded isometric perspective providing a sectional view of both halves of the dual retractable seam ripper of the present invention and illustrating features on many of the respective parts wherein the control button and blade holding/slide block are manufactured as one part.

FIG. 6 is an exploded isometric view of dual blade retractable seam ripper 10 having unitary blade holding/slide block and control button 36 with major seam ripping blade 28 projecting from left end 104 of unitary blade holding/slide block and control button 36 and minor seam ripping blade 30 projecting from right end 106 of unitary blade holding/slide block and control button 36. Longitudinally extending left guide slot 74 formed in left lateral surface 76 of unitary blade holding/slide block and control button 36 is depicted while similar longitudinally extending right guide slot 75 is concealed behind unitary blade holding/slide block and control button 36. Right-hand generally cylindrical tube half 86 has right-hand longitudinally extending guide rail 78 formed medially therein and extending through a major portion of the length of right-hand generally cylindrical tube half 86. Locking depressions 60, 62 and 68 are visible adjacent right control slot recess 80 while right major blade extension opening recess 82 and minor blade extension opening recess 84 are visible at the respective ends of right-hand generally cylindrical tube half 86. Left hand generally cylindrical tube half 92 bears corresponding structure not visible except for left control slot recess 81. Also depicted are thermoplastic elastomer over-molded major cushion 32 disposable over right and left major cushion depressions 88, 90 in right-hand generally cylindrical tube half 86 and left hand generally cylindrical tube half 92, along with minor cushion 34 disposable over right and left minor cushion depressions 94, 96 in right-hand generally cylindrical tube half 86 and left hand generally cylindrical tube half 92. Notches 98, 100 in major and minor cushions 32, 34 align with opposed ends of control slot 27.

Figure 7:
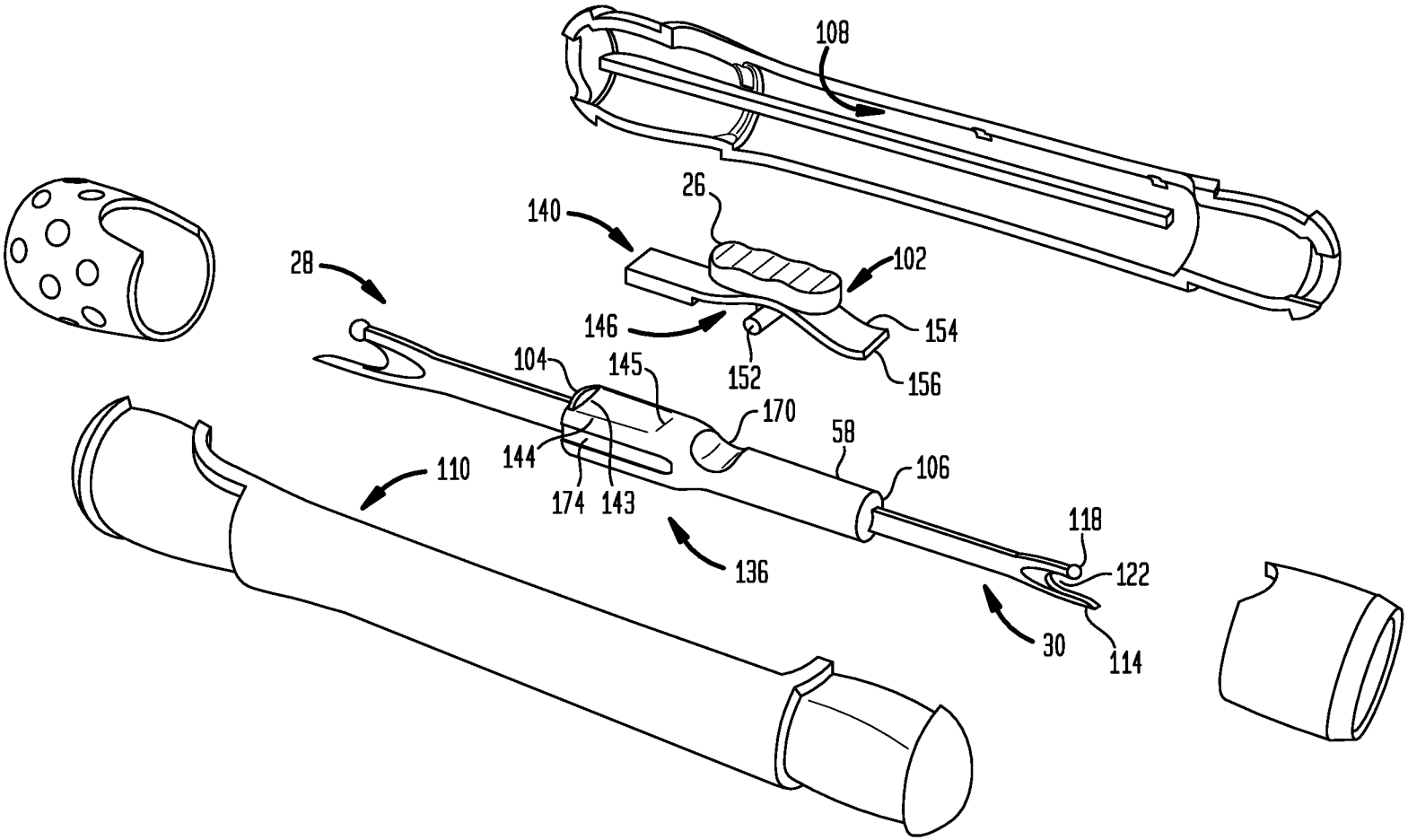
FIG. 7 is an exploded isometric perspective providing a sectional view of both halves of the dual retractable seam ripper of the present invention and illustrating features on many of the respective parts wherein the control button and blade holding slide block are manufactured as separate parts.

FIG. 7 is an exploded isometric view of dual blade retractable seam ripper 10 having discrete blade holding/slide block 136 with longitudinally extending guide slot 174 visible and control button/spring 102 with major seam ripping blade 28 projecting from left end 104 of blade holding/slide block 136 and minor seam ripping blade 30 projecting from right end of blade holding/slide block 106. Control button/spring 102 comprises support base 140 connected to first leaf 146 of spring 102 with base 140 nesting in support base recess 144 in blade holding/slide block 136 and is retained therein by shoulders 143, 145 as well as laterally extending locking pin 152 engaging shoulders 108, 110 formed in generally cylindrical tube 12 adjacent control slot 27 when assembled; while control button 26 rides upon medial portion of leaf 154 having laterally extending locking pin 152 projecting therebeneath with medial relief 170 being formed in blade holding/slide block 136 to accommodate locking pin 152 when control button 26 is depressed to dislodge locking pin 152 from locking depressions 60, 62, and 68 while downwardly projecting cantilever leaf end 156 bears against minor blade retention portion 58 of blade holding/slide block 136. Each retractable ripping blade 28, 30 comprises tapered lower projection 112, 114 and balled upper projection 116, 118 with U-shaped cutting-edge 120, 122 disposed therebetween.

Figure 8:
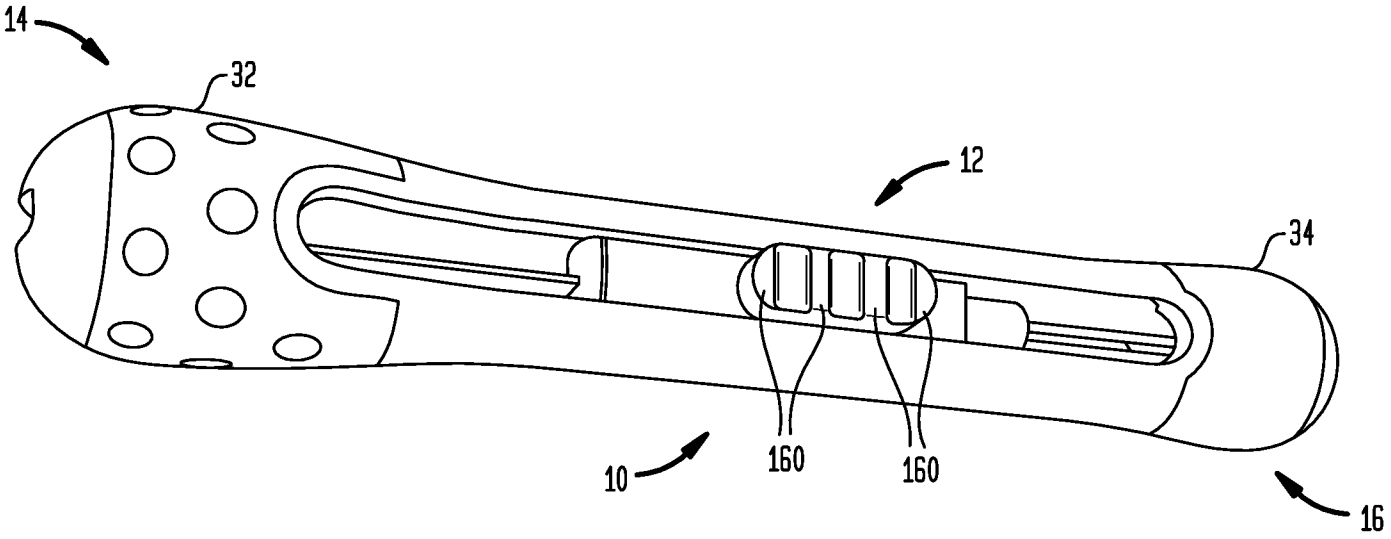
FIG. 8 is an isometric perspective of the dual retractable seam Ripper of the present invention with the blade retracted as in storage.

FIG. 8 illustrates dual ripper 10 of the present invention with control button 26 in the medial position whereby major seam ripping blade 28 and minor seam ripping blade 30 are both retracted within slotted tube 12. Dimples 158 patterned over the surface of major thermoplastic elastomer cushion 32 provides a distinctive appearance while ribs 160 on control button 26 ease manipulation thereof. Note that provision of thermoplastic elastomer cushions 32, 34 provide that each end 14, 16 of dual blade retractable ripper 10 is substantially greater in maximum diameter than slotted generally cylindrical tube 12 easing use thereof by decreasing the likelihood that dual ripper 10 will slip out of the hand during use.

Figure 9:
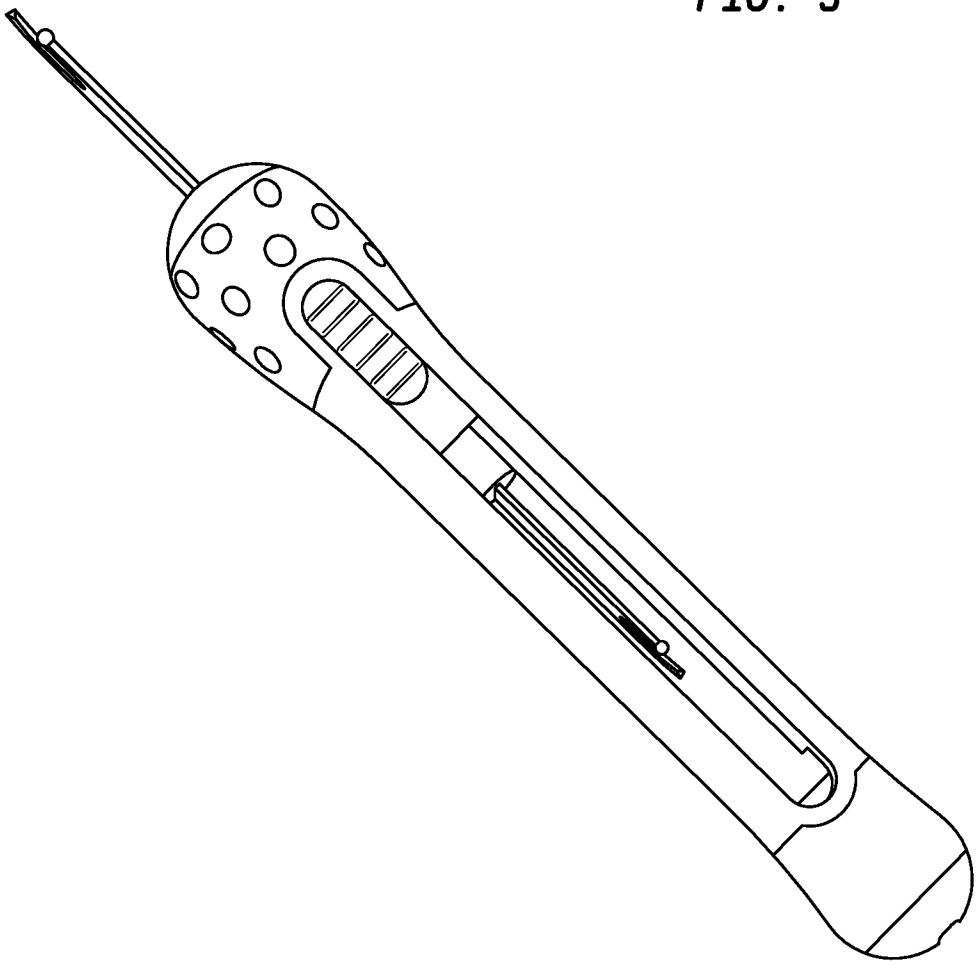
FIG. 9 is a left elevational view of the dual retractable seam ripper of the present invention having the large blade extended.
Figure 10:
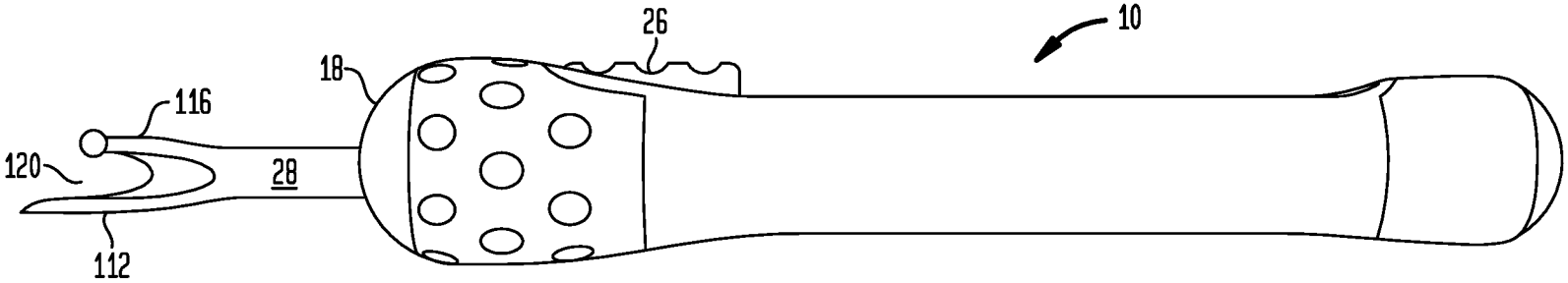
FIG. 10 is a top or plan view of the dual retractable seam ripper of the present invention with the large blade extended.

FIGS. 9 and 10 illustrate dual ripper 10 of the present invention with control button 26 in the leftmost position whereby major seam ripping blade 28 extends beyond generally hemispherical end 18 and is locked in position as described hereinabove while minor seam ripping blade 30 is retracted entirely within tube 12. Note that no cap is necessary to shield either of blades 28 or 30 and thus there is no cap to be lost.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

I claim:

1. A dual blade retractable tool comprising:

a round tubular housing having two ends, one end having a major centrally located blade extension opening formed therein, the other end having a minor centrally located blade extension opening formed therein; a longitudinally extending control slot being formed in the round tubular housing extending a major portion of the length of said round tubular housing;

a one-piece locking mechanism comprising a blade-holding slide block, a control button, and a locking portion being disposed within said round tubular housing, said blade-holding slide block having a major blade support portion and a minor blade support portion, wherein the control button is carried upon a medial portion of a leaf spring, said control button projecting through said control slot and movable therein;

said locking portion being selectably engageable as said control button is moved in said control slot and when said control button is pressed inwardly;

a major blade carried by said major blade support portion and projectable through said major blade extension opening formed in said one end; and a minor blade being carried by said minor blade support portion and projectable through said minor blade extension opening in said other end;

at least one of said blades comprising a tapered projection, wherein said slide block further comprises a guide slot and said round tubular housing further comprises a longitudinally extending guide rail disposed along an interior of said round tubular housing, such that the slide block is slidable along said longitudinally extending guide rail, and wherein the leaf spring projects upwardly from said major blade support portion of said slide block and further comprises a cantilevered end positioned above said minor blade support portion of said slide block, and wherein said medial portion of the leaf spring is positioned therebetween.

2. The dual blade retractable tool of claim 1, wherein thermoplastic elastomer cushions are overmolded around each end of said round tubular housing.

3. The dual blade retractable tool of claim 1, wherein thermoplastic elastomer cushions are overmolded around each end of said round tubular housing.

4. The dual blade retractable tool of claim 1, wherein each end of the round tubular housing is characterized by a greater maximum diameter than the diameter of the round tubular housing therebetween.

5. The dual blade retractable tool of claim 1, wherein the round tubular housing further comprises three locking depressions formed in the interior of the round tubular housing and recessed within the round tubular housing at positions adjacent said longitudinally extending control slot, and wherein the locking portion is selectably engageable with the round tubular housing at said locking depressions.

6. The dual blade retractable tool of claim 1, wherein the major blade and the minor blade further comprise a U-shaped cutting edge.

* * * * *